US005516578A

United States Patent [19]

Coppens

[11] Patent Number: 5,516,578

[45] Date of Patent: May 14, 1996

[54] OIL AND WATER REPELLENT COMPOSITIONS

[75] Inventor: Dirk M. Coppens, Antwerpen, Belgium

[73] Assignee: Minnesota Mining and Manufacturing Company, Saint Paul, Minn.

[21] Appl. No.: 323,278

[22] Filed: Oct. 14, 1994

[30] Foreign Application Priority Data

Oct. 19, 1993 [EP] European Pat. Off. ..... 93116873

[51] Int. Cl.[6] ..... C09D 133/16; C09D 135/00; D06M 15/277

[52] U.S. Cl. ..... 428/260; 428/290; 428/413; 428/421; 428/422; 428/423.4; 428/425.1; 428/473; 428/474.4; 428/479.6; 428/480; 428/481; 428/511; 428/522; 427/389; 427/393.4; 524/100; 524/114; 524/267; 524/306; 524/462; 525/64; 525/65; 525/66; 525/114; 525/115; 525/127; 525/130; 525/167; 525/183; 525/200; 525/207; 525/72

[58] Field of Search ..... 427/389, 393.4; 525/72, 200, 207, 130, 64, 65, 66, 114, 115, 127, 130; 428/260, 290, 413, 421, 422, 423.4, 425.1, 473, 474.4, 479.6, 480, 481, 511, 522; 524/267, 462, 100, 114, 306

[56] References Cited

U.S. PATENT DOCUMENTS

| | | | |
|---|---|---|---|
| 3,341,497 | 9/1967 | Sherman et al. . | |
| 3,420,697 | 1/1969 | Sweeney et al. . | |
| 3,445,491 | 5/1969 | Pacini . | |
| 3,470,124 | 9/1969 | Van Eygen et al. . | |
| 3,544,537 | 12/1970 | Brace . | |
| 3,546,187 | 12/1970 | Tandy, Jr. . | |
| 3,708,327 | 1/1973 | Tomasino | 428/422 |
| 3,955,027 | 5/1976 | Vaughn | 428/262 |
| 3,991,136 | 11/1976 | Dalton | 525/84 |
| 4,054,592 | 10/1977 | Dear | 560/25 |
| 4,070,152 | 1/1978 | Pentz | 8/181 |
| 4,100,225 | 7/1978 | Mueller | 525/72 |
| 4,107,055 | 8/1978 | Sukornick | 428/96 |
| 4,215,205 | 7/1980 | Landucci | 525/331 |
| 4,240,916 | 12/1980 | Rossi | 252/56 D |
| 4,358,573 | 11/1982 | Verbrugge | 526/272 |
| 4,415,694 | 11/1983 | Roiko | 525/200 |
| 4,426,466 | 1/1984 | Schwartz | 523/455 |
| 4,468,527 | 8/1984 | Patel | 564/96 |
| 4,477,498 | 10/1984 | Deiner et al. | 427/381 |
| 4,540,497 | 9/1985 | Chang et al. | 252/8.8 |
| 4,559,386 | 12/1985 | Wu | 525/75 |
| 4,566,981 | 1/1986 | Howells | 252/8.8 |
| 5,132,028 | 7/1992 | Nagase et al. | 252/8.6 |

FOREIGN PATENT DOCUMENTS

| | | |
|---|---|---|
| WO92/17636 | 10/1992 | WIPO . |
| WO93/01348 | 1/1993 | WIPO . |

OTHER PUBLICATIONS

*Encyclopedia of Polymer Science and Eng* vol. 7 p. 565.

Hiemenz "Polymer Chemistry–The Basic Concepts" pp. 34, 35; 1985.

Banks, Ed., *Organofluorine Chemicals and Their Industrial Applications,* Ellis Horwood Ltd., Chichester, England, 1979, 0. 226–234.

*Primary Examiner*—David Buttner

*Attorney, Agent, or Firm*—Douglas B. Little; Gary L. Griswold; Walter N. Kirn

[57] ABSTRACT

The invention relates to a water and oil repellency imparting composition which comprises:

(a) a fluoroaliphatic radical-containing agent; and (b) a polymer comprising cyclic carboxylic anhydride groups.

Additionally, the composition may comprise:

(c) a softener and/or a plasticizer. The composition provides water and oil repellent properties to fibrous and other substrates treated therewith and it shows high compatibility with the commonly used softeners.

9 Claims, No Drawings

OIL AND WATER REPELLENT COMPOSITIONS

TECHNICAL FIELD

This invention relates to a composition comprising a fluoroaliphatic radical-containing agent and a polymer comprising cyclic carboxylic anhydride groups for imparting water and oil repellency to fibrous substrates and other materials treated therewith. In another aspect, this invention relates to a method of using such composition to treat such substrates and materials, and in another aspect it relates to the so-treated substrates and materials.

BACKGROUND

The treatment of fibrous substrates with fluorochemical compositions to impart water and oil repellency is known; see, for example, Banks, Ed., *Organofluorine Chemicals and Their Industrial Applications,* Ellis Horwood Ltd., Chichester, England, 1979, pp. 226–234. Such fluorochemical compositions include, for example, fluorochemical guanidines (U.S. Pat. No. 4,540,497), compositions of cationic and non-ionic fluorochemicals (U.S. Pat. No. 4,566,981), compositions containing fluorochemical carboxylic acid and epoxidic cationic resin (U.S. Pat. No. 4,426,466), and fluoroaliphatic alcohols (U.S. Pat. No. 4,468,527).

Additives have been employed to assist in the oil and water repellency of fluorochemical treating agents.

U.S. Pat. No. 4,215,205 discloses combinations of fluorochemical vinyl polymer and carbodiimide in compositions said to impart durable water and oil repellency to textiles. Some of the carbodiimides disclosed contain fluoroaliphatic groups.

U.S. Pat. No. 5,132,028 discloses compositions for imparting water and oil repellency to fabrics such as silk, said compositions containing a fluorochemical-type, water and oil repellent agent, a carbodiimide, and at least one component selected from the group consisting of plasticizer, metal alcoholate or ester, zirconium salt, alkylketene dimer, aziridine, and alkenyl succinic anhydride.

U.S. Pat. No. 3,955,027 discloses an improved process and composition for water and oil proofing textiles which comprises treating a textile with a polymeric fluorocarbon finishing agent and at least one reactive polymer extender having acid or anhydride functionality and curing the treated textile at from 80° C. to 170° C. for 0.1 to 60 min. The reactive polymer extenders are low molecular weight polymers having a molecular weight of less than about 8000.

U.S. Pat. No. 4,070,152 discloses compositions comprising a textile treating resin which is a fluorine-containing polymer and a novel copolymer of a maleic-anhydride copolymer and a fatty acid amine and an amino organo polysiloxane. Said compositions are useful for increasing the water and oil repellency of substrates such as textiles, paper, or leather.

WO 93/01348 discloses aqueous treating compositions for providing water and oil repellency, stain resistance and dry soil resistance which comprise a) 0.3 to 30% by weight of a water soluble or dispensable fluoroaliphatic radical-containing polyoxyalkylene compound;

b) 0.3 to 30% by weight of an anti-soiling agent, and c) water. The anti-soiling agent may include i.e., styrene-maleic anhydride copolymers and vinyl acetate-maleic anhydride copolymers.

Although water and oil repellent treating agents are readily available, it is well known that they are expensive. Also, the efficiency in water and/or oil repellency is not always satisfactory. Furthermore, when they are employed for the treatment of textiles, they suffer from the disadvantage that they tend to give the treated textile a hard feeling. In order to overcome this problem, silicone softeners are commonly applied. However silicones are usually not compatible with the fluorochemical treating agent, and therefore, the treated substrates typically will show a decrease in water and oil repellency.

DISCLOSURE OF INVENTION

It is an object of the present invention to provide a water and oil repellency imparting composition which is less expensive and which can give higher water and oil repellency with a simple one step treatment technique. A further object of the invention is the provision of a water and oil repellency imparting composition that shows high compatibility with common silicone softeners, so as to give the treated substrate a soft feeling, while maintaining the oil and water repellency.

These objects could be achieved by a water and oil repellency imparting composition comprising:

(a) a fluoroaliphatic radical-containing agent; and (b) a polymer comprising cyclic carboxylic anhydride groups, with the proviso that the composition does not contain water if the fluoroaliphatic radical-containing agent is a water soluble or dispersible polyoxyalkylene compound and the polymer comprising cyclic carboxylic anhydride groups is a styrene-maleic anhydride copolymer or a vinyl acetate-maleic anhydride copolymer.

Applicants have found that a polymer comprising cyclic carboxylic anhydride groups when used together with a fluoroaliphatic radical-containing agent significantly increases the water and oil repellency imparting effect of the latter. It was also found that a significantly smaller amount of fluoroaliphatic radical-containing agent is required for imparting oil and water repellency to the treated substrate if a polymer comprising cyclic carboxylic anhydride groups is additionally used, whereas larger amounts are required when the fluoroaliphatic radical-containing agent is used alone. It was further found that the polymer comprising cyclic carboxylic anhydride groups when used together with a fluoroaliphatic radical-containing agent increases the compatibility of the latter with commonly used silicone softeners, hence treated substrates have a soft feeling while at the same time the high oil and water repellency is retained.

Briefly, in one aspect the present invention provides a water and oil repellency imparting composition for fibrous and other substrates, said composition comprising a fluorochemical-type, water and oil repellent agent (such as a fluoroaliphatic radical-containing polyacrylate or polyurethane) and a polymer comprising cyclic carboxylic anhydride groups. The composition can further optionally comprise other additives such as, e.g., a softener and/or a plasticizer. The composition can be applied, e.g., to a fibrous substrate by contacting the substrate with the composition, for example, by immersing it in a bath of the composition or by spraying the composition onto the substrate. The treated substrate is then dried to remove the solvent therefrom.

The composition of this invention imparts desirable water and oil repellency to the substrates treated therewith without adversely affecting other desirable properties of the substrate, such as soft hand (or feeling). The composition of the present invention can be used for providing water and oil repellency to fibrous substrates such as textiles, papers, non-woven articles or leather or to other substrates such as plastics, wood, metals, glass, stone and concrete.

DETAILED DESCRIPTION

An important feature of compositions of the present invention is that any of the known fluoroaliphatic radical-containing agents useful for the treatment of fabrics to obtain repellency of water and oily and aqueous stains can be used. Fluoroaliphatic radical-containing agents include condensation polymers such as polyesters, polyamides or polyepoxides and vinyl polymers such as acrylates, methacrylates or polyvinyl ethers. Such known agents include, for example, those described in U.S. Pat. Nos. 3,546,187; 3,544,537; 3,470,124; 3,445,491; 3,341,497 and U.S. Pat. No. 3,420,697. Further examples of such fluoroaliphatic radical-containing water and oil repellency imparting agents include those formed by the reaction of perfluoroaliphatic thioglycols with diisocyanates to provide perfluoroaliphatic group-bearing polyurethanes. These products are normally applied as aqueous dispersions for fiber treatment. Such reaction products are described, for example, in U.S. Pat. No. 4,054,592. Another group of compounds which can be used are fluoroaliphatic radical-containing N-methylolcondensation products. These compounds are described in U.S. Pat. No. 4,477,498. Further examples include fluoroaliphatic radical-containing polycarbodiimides which can be obtained by, for example, reaction of perfluoroaliphatic sulfonamido alkanols with polyisocyanates in the presence of suitable catalysts.

The fluorochemical component is preferably a copolymer of one or more fluoroaliphatic radical-containing acrylate or methacrylate monomers and one or more fluorine-free (or hydrocarbon) terminally ethylenically-unsaturated comonomers. Classes of the fluorochemical monomer can be represented by the formulas:

$$R_fR^1OCOC(R^2)=CH_2$$

and $$R_fSO_2N(R^3)R^4OCOC(R^2)=CH_2$$

where $R_f$ is a fluoroaliphatic radical;

$R^1$ is an alkylene with, for example, 1 to 10 carbon atoms, e.g. methylene or ethylene, or is $—CH_2CH(OR)CH_2—$, where R is hydrogen or —COCH 3;

$R^2$ is hydrogen or methyl;

$R^3$ is hydrogen or an alkyl with, for example, 1 to 10 carbon atoms, e.g. methyl or ethyl; and $R^4$ is an alkylene with, for example, 1 to 10 carbon atoms, e.g. methylene or ethylene.

The fluoroaliphatic radical, called Rf for brevity, is a fluorinated, stable, inert, preferably saturated, non-polar, monovalent aliphatic radical. It can be straight chain, branched chain, or cyclic or combinations thereof. It can contain heteroatoms, bonded only to carbon atoms, such as oxygen, divalent or hexavalent sulfur, or nitrogen. $R_f$ is preferably a fully-fluorinated radical, but hydrogen or chlorine atoms can be present as substituents if not more than one atom of either is present for every two carbon atoms. The $R_f$ radical has at least 3 carbon atoms, preferably 3 to 14 carbon atoms, and preferably contains about 40% to about 78% fluorine by weight, more preferably about 50% to about 78% fluorine by weight. The terminal portion of the Rf radical is a perfluorinated moiety, which will preferably contain at least 7 fluorine atoms, e.g., $CF_3CF_2CF_2—$, $(CF_3)_2CF—$, $F_5SCF_2—$. The preferred Rf radicals are fully or substantially fluorinated and are preferably those perfluorinated aliphatic radicals of the formula $C_nF_{2n+1}—$ where n is 3 to 14.

Representative examples of fluorochemical monomers are:

$$CF_3(CF_2)_4CH_2OCOC(CH_3)=CH_2$$

$$CF_3(CF_2)_6(CH_2)_2OCOC(CH_3)=CH_2$$

$$CF_3(CF_2)_6(CH_2)_2OCOCH=CH_2$$

$$CF_3(CF_2)_7(CH_2)_2OCOCH=CH_2$$

$$CF_3(CF_2)_7SO_2\overset{\overset{C_2H_5}{|}}{N}(CH_2)_2OCOCH=CH_2$$

$$CF_3CF_2(CF_2CF_2)_{2-8}(CH_2CH_2)_2OCOCH=CH_2$$

$$CF_3(CF_2)_7SO_2\overset{\overset{CH_3}{|}}{N}(CH_2)_2OCOC(CH_3)=CH_2$$

$$CF_3(CF_2)_7CH_2CH_2SO_2\underset{\underset{CH_3}{|}}{N}CH_2CH2OCOC(CH_3)=CH_2.$$

Preferred co-monomers which can be copolymerized with the above-described fluoroaliphatic radical-containing monomers are not hydrophilic and include those selected from the group consisting of octadecylmethacrylate, 1,4-butanediol diacrylate, laurylmethacrylate, butylacrylate, N-methylolacrylamide, isobutylmethacrylate, vinylchloride and vinylidene chloride.

The relative weight ratio of the fluoroaliphatic monomer(s) to the hydrocarbon co-monomer(s) can vary as is known in the art, and generally the weight ratio of them will be 50–95:50–5.

The polymers comprising cyclic carboxylic anhydride groups which are used together with the fluoroaliphatic radical-containing agent include polymers wherein the cyclic carboxylic anhydride groups are integrated into the polymer chain as well as polymers wherein these groups are present as pendant cyclic carboxylic anhydride groups. The former include copolymers of a compound having a terminal ethylenically unsaturated bond and of a cyclic carboxylic anhydride having an ethylenically unsaturated bond whereas the latter include polymers and copolymers of ethylenically unsaturated compounds carrying the cyclic carboxylic anhydride groups as groups pending at the main polymer chain.

Suitable copolymers of a compound having a terminal ethylenically unsaturated bond and a cyclic carboxylic anhydride having an ethylenically unsaturated bond useful in the composition of this invention are described, for example, in U.S. Pat. No. 4,240,916 and U.S. Pat. No. 4,358,573. The cyclic carboxylic anhydride can be an alkyl or aryl substituted or unsubstituted cyclic carboxylic anhydride wherein the alkyl groups contain preferably up to 6 carbon atoms each and the cyclic group contains preferably 4 to 15 carbon atoms, such as maleic or itaconic anhydride. Preferred is maleic anhydride. The compound having a terminal ethylenically unsaturated bond is preferably a 1-alkene, styrene, α methylstyrene, a (meth)acrylic acid derivative, such as an acrylic or methacrylic acid ester, or a vinylether. Such monomers can be used alone or as mixtures. The cyclic carboxylic anhydride can be used in an amount of about 10–70, preferably about 35–70 mol percent. More preferably 45–60 mol percent of ethylenically unsaturated cyclic anhydride is copolymerized with 40– 55 mol percent of at least one $C_2$ to $C_{30}$ aliphatic 1-alkene to produce a copolymer such as, e.g., a maleic anhydride/octadecene copolymer, maleic anhydride/decene copolymer, and maleic anhydride/tetradecene copolymer. It is also preferred to copolymerize 45–60 mol percent of a cyclic carboxylic anhydride with 40–50 mol percent of a vinylether of preferably less than 30 carbon atoms to produce a copolymer such as, e.g. a maleic anhydride/octadecyl vinylether copolymer or maleic anhydride/methylvinylether copolymer. It is further preferred to copolymerize 45–60 mole percent of a cyclic carboxylic anhydride with 40–55 mol percent styrene to produce, e.g. a maleic anhydride/styrene copolymer.

The copolymers of a compound having a terminal ethylenically unsaturated bond and a cyclic carboxylic anhydride having an ethylenically unsaturated bond preferably used in the invention are composed of subunits of the following formula (I):

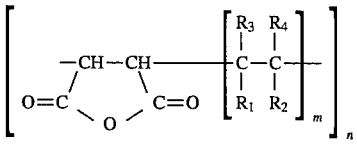

(I)

wherein the residues $R_1$ and $R_2$ may be both hydrogen or one of them is hydrogen and the other is an aliphatic or aromatic group of not more than 30 carbon atoms which may contain up to 5 heteroatoms, $R_3$ and $R_4$ are independently hydrogen or methyl, n is an integer of 50 to 1000 and m is an integer of at least 1, which value depends on the molar ratios of the monomers used.

$R_1$ or $R_2$ is preferably hydrogen, an alkyl group, an unsubstituted or $C_1$–$C_5$ alkyl substituted phenyl group, an ether group, or a carboxylic ester group. If $R_1$ or $R_2$ is an alkyl group, it contains preferably up to about 28 carbon atoms, more preferably up to 22 carbon atoms. If $R_1$ or $R_2$ is an ether group or a carboxylic ester group, it contains preferably not more than 30 carbon atoms.

n is preferably an integer from 50 to 750, and m is preferably at least 1.

The residues $R_1$ and $R_2$ need not necessarily all be the same.

The most preferred copolymers are composed of subunits of the following formulae:

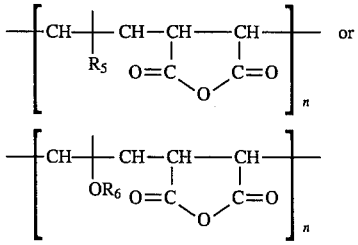

or wherein $R_5$ is hydrogen or alkyl having up to 30 carbon atoms, $R_6$ is alkyl with up to 30 carbon atoms and n is as defined above, the dashed line indicates that $R_5$ and $OR_6$ may be linked to either of the two carbon atoms while the other carries a second hydrogen atom.

Suitable polymers having pendant cyclic carboxylic anhydride groups include polyolefins and poly(meth)acrylic acid derivatives such as esters having such groups pendant at the main polymer chain. Specific examples are copolymers of octadecylmethacrylate (ODMA) with allylmethacrylate (AMA) grafted with maleic anhydride, or polybutadiene polymers grafted with maleic anhydride.

The ratio of fluoroaliphatic radical-containing agent to polymer comprising cyclic carboxylic anhydride groups is preferably between 1:0.02 and 1:3, more preferably between 1:0.05 and 1:1.5 by weight.

The composition of the present invention may further comprise other additives usually employed in oil and water repellency imparting compositions, such as softeners, e.g., silicone softening agents, and/or plasticizers. The softening agent will increase the soft feeling of the treated substrate. Suitable silicone softening agents include those selected from the group consisting of polydimethylsiloxanes, and polyhydroxymethylsiloxanes. If used, the softening agent is present in an amount between 5% and 300% by weight, preferably between 15% and 200% by weight, based on the fluoroaliphatic radical-containing agent.

Suitable plasticizers include aliphatic or aromatic esters, such as dioctyladipate, dioctylazelate, ditridecyladipate, di(2-ethylhexyl)azelate, di(2-ethylhexyl)maleate, diethylhexylsebacate, butylbenzylphtalate, dioctylphtalate, dibutylphtalate, diisodecylphtalate, ditridecylphtalate, and diisononylphtalate; polyester type plasticizers such as Priplast plasticizers (available from Unichema Chemie GmbH, Emmerich, GERMANY) paraffins and substituted paraffins, such as Chlorparaffins (available from Hüs AG, Marl, GERMANY) epoxy type plasticizers, such as Rheoplast plasticizers (available from Ciba-Geigy AG, Basel, SWITZERLAND). If used, the plasticizer is present in an amount of between 10 and 200%, preferably between 20 and 100% by weight of the fluoroaliphatic radical-containing agent.

For application, the water and oil repellency imparting composition can be used in solvent solution, emulsion and aerosol forms. Preferably, the composition is used in solvent solution form.

Suitable solvents are those that are capable of solubilizing the fluoroaliphatic radical-containing agent, the polymer comprising cyclic carboxylic anhydride groups and the optional silicone softener and plasticizer. Suitable solvents include chlorinated hydrocarbons, isoparaffinic hydrocarbons, alcohols, esters, ketones and mixtures thereof. Usually, the solvent solutions will contain 0.1 to 10% or even up to 50% by weight solids.

Water is not used as a solvent for the water and oil repellency imparting composition of the present invention if the fluoroaliphatic radical-containing agent is a water soluble or dispersible polyoxyalkylene compound and the polymer comprising cyclic carboxylic anhydride groups is a styrene-maleic anhydride copolymer or a vinyl acetate-maleic anhydride copolymer. As the presence of water in solutions of the compositions of the invention may cause ring opening of the cyclic anhydride which will impair the performance properties of the cyclic anhydride copolymer, it is generally preferred beyond the above restriction that solutions of the compositions of the invention are substantially water free. This means that solutions of the composition of the present invention preferably do not contain more than 5% by weight, more preferably not more than 1% by weight, and still more preferably not more than 0.5% by weight of water, based on the total weight of the composition. Most preferably the compositions of the invention and their solutions do not contain any water.

The amount of the composition applied to a substrate in accordance with this invention is chosen so that sufficiently high or desirable water and oil repellencies are imparted to the substrate surface, said amount usually being such that 0.01% to 5% by weight, preferably 0.05 to 2% by weight, based on the weight of the substrate, of fluoroaliphatic radical-containing agent and polymer comprising cyclic carboxylic anhydride groups is present on the treated substrate. The amount which is sufficient to impart desired repellency can be determined empirically and can be increased as necessary or desired.

The treatment of fibrous substrates using the water and oil repellency imparting composition of the present invention is carried out by using well-known methods including dipping, spraying, padding, knife coating, and roll coating. Drying of the substrate is done at 120° C. or below, including room temperature, e.g. about 20° C. with optionally heat-treating the textile products in the same manner as in conventional textile processing methods.

The substrates treated by the water and oil repellency imparting composition of this invention are not especially limited and include, e.g., textile fabrics, fibers, nonwovens, leather, paper, plastic, wood, metal, glass, concrete and stone.

Respective data of water and oil repellency shown in the Examples and Comparative Examples are based on the following methods of measurement and evaluation criteria:

Spray Rating

The spray rating (SR) of a treated substrate is a value indicative of the dynamic repellency of the treated substrate to water that impinges on the treated substrate, such as encountered by apparel in a rain storm. The rating is measured by Standard Test Number 22, published in the 1977 Technical Manual and Yearbook of the American Association of Textile Chemists and Colorists (AATCC), and is expressed in terms of the "spray rating" of the tested substrate. The spray rating is obtained by spraying water on the substrate and is measured using a 0 to 100 scale where 100 is the highest possible rating.

Oil Repellency

The oil repellency (OR) of a treated substrate is measured by the American Association of Textile Chemists and Colorists (AATCC) Standard Test Method No. 118–1983, which test is based on the resistance of treated substrate to penetration by oils of varying surface tensions. Treated substrates resistant only to Nujol®, mineral oil (the least penetrating of the test oils) are given a rating of 1, whereas treated substrates resistant to heptane (the most penetrating of the test oils) are given a rating of 8. Other intermediate values are determined by use of other pure oils or mixtures of oils, as shown in the following table.

Standard Test Liquids

| AATCC Oil Repellency Rating Number | Composition |
|---|---|
| 1 | Nujol ® |
| 2 | Nujol ®/n-hexadecane 65/35 |
| 3 | n-Hexadecane |
| 4 | n-Tetradecane |
| 5 | n-Dodecane |
| 6 | n-Decane |
| 7 | n-Octane |
| 8 | n-Heptane |

Abbreviations:

The following abbreviations and trade names are used in the examples:

| | |
|---|---|
| PA-18: | 1:1 Copolymer of 1-octadecene with maleic anhydride having a molecular weight of about 30000 to 50000, available from Chevron Chemical Company, Geneve, SWITZERLAND |
| MA: | maleic anhydride |
| ODMA: | octadecylmethacrylate |
| AMA: | allylmethacrylate |
| ODVE: | octadecyl vinylether |
| GANTREZ AN119: GANTREZ AN169: GANTREZ AN179: | Copolymers of polymethyl vinylether with maleic anhydride; MN = 20000 (GANTREZ AN119), Mn = 67000 (GANTREZ AN169) and Mn = 80000 (GANTREZ AN179), available from GAF chemical Corp., Wayne N.J., U.S.A. |
| SMA 3000A: | Styrene-maleic anhydride copolymer, available from Atochem S.A., Paris, FRANCE |
| Baysilan Ol M3 (Bay Ol M3): | Polydimethylsiloxane, available from Bayer AG., Leverkusen, GERMANY |
| Lithene LX16-10MA: Lithene N4-5000-10MA: Lithene PM25MA: | Liquid Polymers of Butadiene chemically modified by 10 weight % MA (LX16-10MA and N4-5000-10MA) or 25 weight % MA (PM-25-MA), available from Revertex, Harlow, U.K. |
| SH8011: | A 50% solution in mineral spirits of polydimethylsiloxane, polyhydroxymethylsiloxane and $Zn(BF_4)_2$ available from Toray Industries Inc., Tokyo, JAPAN |
| Wacker CT 51L (Wa CT 51L): | A 25% solution in toluene of a high molecular weight silicone, available from WackerChemie GmBH, Munich, GERMANY |
| WPU: | Wet pick up |
| SOF: | Solids on fibre |
| MIBK: | Methyl isobutyl ketone |
| DOZ: | Dioctylazelate |

EXAMPLE

The following examples are intended to be illustrative and should not be construed as limiting the invention in any way. All parts, ratios, percentages, etc. in the examples and the rest of the specification, are by weight unless otherwise noted.

Fluoroaliphatic radical-containing agents

The fluoroaliphatic radical-containing agents used in the examples of the present invention are commercially available from 3M:

FX-3530 is a fluoroaliphatic radical-containing polymethacrylate, sold as a 25% solution of fluoropolymer in ethylacetate/heptane.

FX-3532 is a fluoroaliphatic radical-containing polyurethane, sold as a 40% solution of fluoropolymer in ethylacetate.

FX-3534 is a fluoroaliphatic radical-containing polymethacrylate, sold as a 30%; solution of fluoropolymer in methylethylketone.

Commercially available substrates

| | |
|---|---|
| Pes/Co Utex: | Grey polyester/cotton 65/35, style No. 2681, obtained through Utexbel N.V., Ghent, BELGIUM. |

-continued

| Commercially available substrates | |
|---|---|
| 100% Cotton: | Bleached, mercerized cotton poplin, style No. 407, purchased from Testfabrics, Inc., U.S.A. |
| 100% Silk: | YIS Colour fastness test substrate. |

Synthesis of polymers comprising cyclic carboxylic anhydride groups in the polymer main chain.

Several polymers comprising cyclic carboxylic anhydride groups as given in Table 1 have been prepared according to the general method as described below (as cyclic carboxylic anhydride, maleic anhydride was used):

In a three necked flask equipped with a mechanical stirrer, a nitrogen inlet and a condenser were placed a compound having a terminal ethylenically unsaturated bond and maleic anhydride in a solvent at 50% solids (30% in case of the (meth) acrylic esters). The solvent used is listed in Table 1. To this mixture was added 2% by weight of azobisisobutyronitrile (AIBN), based on monomer weight (0.3% in case of the (meth) acrylic esters, plus 0.3% n-octylmercaptan). The reaction mixture was purged with nitrogen and reacted at 72° C. under nitrogen during 16 hours (20 hours in case of the (meth)acrylic esters). In all cases clear viscous solutions were obtained.

TABLE 1

Preparation of polymers comprising cyclic carboxylic anhydride groups in the polymer main chain

| Used in Ex. No. | Compound Having a Terminal Ethylenically Unsaturated Bond | Mol Ratio Maleic Anhydride/Compound Having a Terminal Ethylenically Unsaturated Bond | Solvent |
|---|---|---|---|
| 33 | 1-Octadecyl vinylether | 50:50 | Toluene |
| 34 | 1-Hexadecene | 50:50 | Toluene |
| 35 | 1-Decene | 50:50 | Toluene |
| 36 | 1-Tetradecene | 50:50 | Toluene |
| 37 | 1-Hexene | 50:50 | MIBK |
| C-13 | Octadecyl-methacrylate | 0:100 | Ethylacetate |
| 71 | Octadecyl methacrylate | 45:55 | Ethylacetate |
| C-14 | Butylmethacrylate | 0:100 | Ethylacetate |
| 72 | Butylmethacrylate | 26:74 | Ethylacetate |
| 73 | Butylmethacrylate | 49:51 | Ethylacetate |

Molecular weight analysis of the polymers comprising cyclic carboxylic anhydride groups in the polymer main chain.

The GPC (gel phase chromatography) analysis has been done using a Perkin Elmer Series 400 pump autosampler from Polymer Laboratories. The columns (30 cm-0.46 cm) are packed with PL gel (polystyrene crosslinked with divinylbenzene) with a particle size of 10 micron. The eluent used is THF (tetrahydrofuran). Flow rate: 1 ml/min. The calibration is done with polystyrene standards having molecular weights between 1200 and 2,950,000. The flow rate marker is toluene. The molecular weight is calculated with a PL GPC data station version 3.0. Detection is done with a PE LC25 refractive index detector. The results of the analysis are given in Table 2 below: Mw is the weight average molecular weight; Mp is the peak molecular weight; Mn is the number average molecular weight and p is the polydispersity (Mw/Mn).

TABLE 2

Molecular weight analysis

| Copolymer of Maleic Anhydride with | Mn | Mw | Mp | p |
|---|---|---|---|---|
| 1-octadecyl vinylether | 131 832 | | 145 622 | |
| 1-Hexadecene | 6 017 | 11 324 | 9 228 | 1.9 |
| 1-Decene | 5 400 | 12 427 | 10 975 | 2.3 |
| 1-Tetradecene | 7 092 | 11 924 | 9 890 | 1.7 |
| 1-Hexene | 7 759 | 14 390 | 11 227 | 1.9 |

Synthesis of polymers comprising pendant cyclic carboxylic anhydride groups (Meth)acrylate polymers comprising pendant cyclic carboxylic anhydride groups have been prepared according to the general method as described below:

In three necked flasks equipped with a mechanical stirrer, a nitrogen inlet and a condenser were placed octadecyl methacrylate and allylmethacrylate in a ratio of 90/10 and 80/20, respectively. The monomers were diluted with butylacetate to 40%. To these mixtures was added 0.75% by weight of initiator azobisisobutyronitrile (AIBN), and 1% chain transfer agent n-octylmercaptan (based on monomer weight). The reaction mixtures were purged with nitrogen and reacted at 72° C. under nitrogen during 16 hours.

In a second step, maleic anhydride was grafted to the methacrylic polymers, according to the following method:

To the allyl (meth)acrylate copolymers prepared as described above, maleic anhydride was added in an amount to provide a 1/1 molar ratio of the maleic anhydride to the allyl(meth)acrylate. Additional 1% AIBN based on the total solids was added and the mixtures were further diluted with butylacetate to 30% solids. The mixtures were purged with nitrogen and further reacted at 72° C. for another 16 hours.

The copolymers ODMA/AMA 90/10 and 80/20, grafted with MA are evaluated in examples 74 and 75, respectively. The copolymers ODMA/AMA 90/10 and 80/20 that were not grafted with MA are used in comparative examples C-16 and C-17 (see also table 13).

Examples 1 to 6 and Comparative Examples C-1 to C-3

In examples 1 to 6, blends were made of FX-3530, FX-3532 or FX-3534 with PA-18 in MIBK in different ratios as given in Table 3. The blends were applied to Pes/Co Utex fabric by solvent padding, at 100% WPU. The fabrics were dried at 70° C. for 30 minutes. Alternatively, the fabrics were additionally ironed at 150° C. for 5 sec. Comparative examples C-1 to C-3 were made without the addition of PA-18. In all cases, the tests were done in a way to give a concentration of the treating solution of 0.3% solids on fibre. The results are given in Table 3.

TABLE 3

Performance properties of Pes/co Utex substrate treated with fluoroaliphatic radical-containing agent-PA-18 mixtures

| Ex. | Fluoroaliphatic Radical-Containing | Ratio* | Dried | | Dried + Ironed | |
|---|---|---|---|---|---|---|
| No. | Agent (FC) | FC/PA-18 | OR | SR | OR | SR |
| 1 | FX-3530 | 90/10 | 4 | 100 | 4 | 100 |
| 2 | FX-3530 | 80/20 | 4 | 100 | 4 | 100 |

TABLE 3-continued

Performance properties of Pes/co Utex substrate treated with fluoroaliphatic radical-containing agent-PA-18 mixtures

| Ex. No. | Fluoroaliphatic Radical-Containing Agent (FC) | Ratio* FC/PA-18 | Dried OR | Dried SR | Dried + Ironed OR | Dried + Ironed SR |
|---|---|---|---|---|---|---|
| 3 | FX-3532 | 90/10 | 4 | 70 | 4 | 70 |
| 4 | FX-3532 | 80/20 | 4 | 70 | 4 | 70 |
| 5 | FX-3534 | 90/10 | 4 | 100 | 4 | 100 |
| 6 | FX-3534 | 80/20 | 4 | 100 | 4 | 100 |
| C-1 | FX-3530 | 100/0 | 4 | 70 | 4 | 80 |
| C-2 | FX-3532 | 100/0 | 4 | 50 | 5 | 50 |
| C-3 | FX-3534 | 100/0 | 4 | 90 | 4 | 90 |

Note: Ratio *: weight % of solid material

The results of the experiments shown in this table indicate that in all cases an improvement of the spray rating is observed, even when small amounts (10%) of the fluoroaliphatic radical-containing agent are replaced by PA-18. The oil repellency rating remains at the same high level.

Examples 7, 8 and Comparative Example C-4

In example 7, a treatment solution containing FX3530, PA-18 and dioctylazelate plasticizer in MIBK was used. Example 8 was carried out the same way, except that SMA 3000A was used instead of PA-18.

Comparative example C-4 was carried out in the same way but no polymer comprising cyclic carboxylic anhydride groups was used.

The treatment solutions were applied to different substrates by solvent padding, at 100% WPU. The treated fabrics were dried at room temperature, eventually followed by a heat treatment for 15 sec at 150° C. (ironed). This method provided the fabrics with 0.3% SOF FX-3530, 0.06% SOF polymer comprising cyclic carboxylic anhydride groups (except for C4) and 0.15% SOF plasticizer. The results are given in Table 4.

TABLE 4

Performance properties of substrates treated with mixtures of fluoroaliphatic radical-containing agent and polymer comprising cyclic carboxylic anhydride groups.

| Ex. No. | Polymer Comprising Cyclic Carboxylic Anhydride Groups | 100% Cotton Air Dry OR | 100% Cotton Air Dry SR | 100% Cotton Ironed OR | 100% Cotton Ironed SR | Silk Air Dry OR | Silk Air Dry SR | Silk Ironed OR | Silk Ironed SR |
|---|---|---|---|---|---|---|---|---|---|
| 7 | PA-18 | 4 | 100 | 3 | 100 | 4 | 100 | 4 | 95 |
| 8 | SMA 3000A | 4 | 80 | 2 | 80 | 3 | 90 | 4 | 85 |
| C-4 | / | 3 | 60 | 1 | 70 | 4 | 80 | 4 | 80 |

Again, it is shown that the tested treatment solutions containing a polymer comprising cyclic carboxylic anhydride groups give improved oil and water repellency as compared to the fluorochemical treatment solution without such polymers added. Both SR and OR values indicate that it is not required to give the fabric a heat curing treatment after application.

Example 9 and Comparative Example C-5

The same kind of experiment as outlined for Example 4 was repeated but the treatment solutions were made in perchloroethylene for dry clean applications and no additional plasticizer was used. As substrate, Pes/Co Utex was chosen and the composition was applied by solvent padding to give a total of 0.1% SOF (0.08% SOF FX-3530 and 0.02% SOF PA-18 for example 9 and 0.1% SOF FX-3530 for C-5) after drying, which is a typical add-on for dry clean applications. The treated substrates have been dried at 70° C. for 30 min, eventually followed by ironing at 100° C. for 5 sec. Comparative example C-5 was made without PA-18. The results are given in Table 5.

TABLE 5

Performance properties of substrates treated with FX-3530 with and without PA-18, respectively.

| Ex. No. | Dried OR | Dried SR | Dried + Ironed OR | Dried + Ironed SR |
|---|---|---|---|---|
| 9 | 1 | 80 | 1 | 100 |
| C-5 | 0 | 50(W) | 0 | 50(W) |

Note: (W): Reverse side is wet

The sample with the PA-18 reaches the minimum requirement for dry clean application, being an oil repellency rating of 1 and a spray rating of 100 after ironing.

Examples 10 to 19 and Comparative Example C-6

In examples 10 to 13, FX-3530 was gradually replaced by PAl8, so as to obtain a constant level of 0.3% solids on fibre after drying. In examples 14 to 19, the level of FX-3530 was kept constant at 0.3% SOF and the amount of PA-18 was gradually increased. Comparative Example C-6 was made without the addition of PA-18. All treatment solutions in MIBK of examples 10 to 19 and Comparative Example C-6 were applied to Pes/Co Utex fabric. After treatment, the fabric was dried at 70° C. for 30 min, eventually followed by heat treatment at 150° C. for 5 sec (ironed). The results of oil and water repellency test are given in Table 6.

TABLE 6

Performance properties of Pes/Co Utex substrate treated with FX-3530 - PA-18 in different ratios

| Ex. | | | Dried | | Dried + Ironed | |
|---|---|---|---|---|---|---|
| No. | % SOF FX-3530 | PA-18 | OR | SR | OR | SR |
| 10 | 0.24 | 0.06 | 4 | 100 | 4 | 100 |
| 11 | 0.18 | 0.12 | 3 | 100 | 3 | 100 |
| 12 | 0.12 | 0.18 | 2 | 100 | 2 | 100 |
| 13 | 0.06 | 0.24 | 1 | 90 | 1 | 90 |
| 14 | 0.3 | 0.03 | 4 | 100 | 3 | 100 |
| 15 | 0.3 | 0.06 | 4 | 100 | 3 | 100 |
| 16 | 0.3 | 0.12 | 4 | 100 | 3 | 100 |
| 17 | 0.3 | 0.18 | 4 | 100 | 3 | 100 |
| 18 | 0.3 | 0.3 | 4 | 100 | 4 | 100 |
| 19 | 0.3 | 0.6 | 5 | 100 | 4 | 100 |
| C-6 | 0.3 | 0 | 4 | 80 | 3 | 80 |

The results indicate that even a small amount of PA-18 gives a significant improvement of the spray rating. The performance of the treated samples remain high, even when about half of the amount of FX-3530 is replaced by PA-18. The addition of higher amounts (higher than 0.3% SOF) of PA-18 to the fluoroaliphatic radical-containing agent does not increase the performance of the treated samples substantially, but it does not deteriorate the performance either.

Examples 20 to 22 and comparative Examples C-7 to C-9

In the examples 20 to 22 various silicone softening agents were evaluated in combination with the water and oil repellency imparting compositions of the present invention, to improve the softness of the treated fabric. Treatment solutions were applied to the fabrics by solvent padding, to give a concentration of 0.3% SOF of silicone softener, 0.3 SOF of FX-3530, 0.15% SOF Dioctylazelate and 0.06%; SOF of PA-18. Comparative examples C-7 to C-9 were made without addition of PA-18.

All treatment solutions (in MIBK) were applied to the fabric by solvent padding. The treated fabrics are dried at room temperature (examples 20 and 21 and comparative examples C-7 and C-8) or at 70° C. for 30 min (example 22 and comparative example C-9) eventually followed by heat cure at 150° C. for 15 sec (Ironed). The results are given in Table 7.

TABLE 7

Performance properties of substrates treated with mixtures of FX-3530, PA-18 and silicone softener

| Ex. | Silicone | PA-18 | 100% Cotton | | | | Pes/co Utex | | | |
|---|---|---|---|---|---|---|---|---|---|---|
| | | | Dried | | Ironed | | Dried | | Ironed | |
| No. | type | SOF | OR | SR | OR | SR | OR | SR | OR | SR |
| 20 | SH8011 | 0.3 | 6 | 100 | 3 | 100 | 5 | 100 | 3 | 100 |
| C-7 | SH8011 | 0 | 3 | 90 | 3 | 90 | 5 | 100 | 3 | 100 |
| 21 | BayOl M3 | 0.3 | 2 | 100 | 2 | 100 | 1 | 100 | 2 | 100 |
| C-8 | BayOl M2 | 0 | 4 | 70 | 4 | 70 | 4 | 60 | 4 | 60 |
| 22 | Wa CT51L | 0.3 | | | | | 5 | 100 | 5 | 100 |
| C-9 | Wa CT51L | 0 | | | | | 5 | 70 | 5 | 70 |

Note: the samples containing Wacker CT 51L contain 0.13% SOF dioctylazelate.

In most cases, the addition of PA-18 increases the spray rating of the treated fabric. Except for the Baysilan 01 M3, the oil rating remains about the same.

Examples 23 to 29 and Comparative Example C-10

In examples 23 to 29, different amounts of PA-18 were used in combination with FX-3530 (0.3% SOF), silicone softener SH8011 (0.3% SOF) and Dioctylazelate plasticizer (0.15 SOF). The treatment solutions were applied to 100% cotton by solvent padding (MIBK). The treated substrates were dried at room temperature and conditioned overnight before testing. Comparative example C-10 was made without PA-18. The results of oil repellency and spray rating are given in Table 8.

TABLE 8

Performance properties of 100% cotton treated with FX-3530/PA-18

| | | PA-18, % of FX-3530 | 100% Cotton | |
|---|---|---|---|---|
| Ex. No. | PA-18, % SOF | Solids | OR | SR |
| 23 | 0.006 | 2 | 5 | 90 |
| 24 | 0.015 | 5 | 5 | 95 |
| 25 | 0.03 | 10 | 5 | 100 |
| 26 | 0.06 | 20 | 5 | 100 |
| 27 | 0.15 | 50 | 5 | 100 |
| 28 | 0.3 | 100 | 5 | 100 |
| 29 | 0.6 | 200 | 5 | 100 |
| C-10 | 0.0 | 0 | 4 | 90 |

The results indicate that even a very small amount of PA-18 causes already an increase in oil repellency. It is also clear that there is no real limit on the addition of PA-18. Preferably a minimum amount of PA-18 of 5% of the FX-3530 solids is used.

Examples 30 to 37 and Comparative Example C-11

In examples 30 to 37 blends were made of FX-3530 with different polymers comprising cyclic carboxylic anhydride groups in MIBK in a ratio of 80/20. The blends were applied to Pes/Co Utex fabric by solvent padding, at 100% WPU. The fabrics were dried at 65° C. for 30 minutes, eventually also ironed at 150° C. for 5 sec. Comparative example C-11 was made without the addition of such a polymer. The test was done in a way to give a concentration of the treating composition of 0.3% solids on fibre. The results of testing are given in Table 9.

TABLE 9

Performance properties of Pes/Co Utex substrate treated with mixtures of fluoroaliphatic radical containing agent and a polymer comprising cyclic carboxylic anhydride groups

| Ex. No. | Polymer comprising Cyclic Carboxylic Anhydride Groups | Dried OR | Dried SR | Dried + Ironed OR | Dried + Ironed SR |
|---|---|---|---|---|---|
| 30 | Gantrez AN119 | 2 | 100 | 2 | 100 |
| 31 | Gantrez AN169 | 2 | 100 | 2 | 100 |
| 32 | Gantrez AN179 | 2 | 100 | 2 | 100 |
| 33 | ODVE/MA | 3 | 90 | 2 | 100 |
| 34 | Hexadecene/MA | 3 | 100 | 3 | 100 |
| 35 | Decene/MA | 2 | 100 | 2 | 100 |
| 36 | Tetradecene/MA | 3 | 100 | 3 | 100 |
| 37 | Hexene/MA | 3 | 100 | 2 | 100 |
| C-11 | / | 3 | 80 | 3 | 80 |

Although 20% of the fluoroaliphatic radical-containing agent is replaced by a polymer comprising cyclic carboxylic anhydride groups, very little influence is seen on the oil repellency of the treated sample. Moreover, the water repellency is increased.

Examples 38-, to 57

In examples 38 to 57 different plasticizers were evaluated in the water and oil repellency imparting composition of the present invention. In all examples, a solution in MIBK of FX-3530 (0.3% SOF), silicone softener SH8011 (0.3% SOF), PA-18 (0.06% SOF) and plasticizer (0.15% SOF) was used to treat a 100% cotton substrate. The treated substrate was dried at room temperature and conditioned overnight before testing. The results are given in Table 10.

TABLE 10

Performance properties of 100% cotton substrate treated with fluoroaliphatic radical-containing agent, polymer comprising cyclic carboxylic anhydride groups, silicone softener and plasticizer.

| Ex. No. | Plasticizer Type | 100% Cotton OR | 100% Cotton SR |
|---|---|---|---|
| 38 | Chlorparaffin 45 G | 5 | 100 |
| 39 | Chlorparaffin 40 N | 5 | 95 |
| 40 | Chlorparaffin 52 G | 5 | 95 |
| 41 | Chlorparaffin 40 G | 5 | 100 |
| 42 | Priplast 3124 | 6 | 95 |
| 43 | Priplast 3155 | 5 | 90 |
| 44 | Priplast 3114 | 5 | 100 |
| 45 | Priplast 3126 | 5 | 100 |
| 46 | Priplast 3157 | 5 | 100 |
| 47 | Priplast 3159 | 5 | 100 |
| 48 | Ditridecyladipate | 6 | 100 |
| 49 | Dioctylazelate | 6 | 100 |
| 50 | Diethylhexylsebacate | 6 | 100 |
| 51 | Diisodecylphtalate | 6 | 100 |
| 52 | Dibutylphtalate | 3 | 100 |
| 53 | Dioctylphtalate | 6 | 100 |
| 54 | Butylbenzylphtalate | 6 | 100 |
| 55 | Ditridecylphtalate | 6 | 100 |
| 56 | Diisononylphtalate | 6 | 100 |
| 57 | Rheoplast 39 | 6 | 100 |

Notes:
Chlorparaffin: available from Hüls

TABLE 10-continued

Performance properties of 100% cotton substrate treated with fluoroaliphatic radical-containing agent, polymer comprising cyclic carboxylic anhydride groups, silicone softener and plasticizer.

| Ex. No. | Plasticizer Type | 100% Cotton OR | 100% Cotton SR |
|---|---|---|---|

Priplast: available from Unichema
Rheoplast 39: epoxytype plasticizer from Ciba-Geigy The results in this table indicate that the performance of the treated substrate is high, independent of the structure of the added plasticizer.

Examples 58 to 70

In examples 58 to 70 the amount of the plasticizer has been varied. In all cases, solutions in MIBK of FX-3530 (0.3% SOF), PA-18 (0.06% SOF), silicone softener SHBOll (0.3% SOF) and plasticizer (various amounts as given in table 11) were applied to 100% cotton. The plasticizers evaluated were butylbenzylphtalate (BBP) and dioctylazelate (DOZ). The treated substrates were dried at room temperature and conditioned overnight before testing. The results of oil repellency and spray rating are given in Table 11.

TABLE 11

Performance properties of 100% cotton substrate treated with fluoroaliphatic radical-containing agent, polymer comprising cyclic carboxylic anhydride groups, silicone softener and plasticizer

| Ex. No. | Plasticizer Type | Plasticizer SOF | Plasticizer % Solids of FX-3530 | 100% Cotton OR | 100% Cotton SR |
|---|---|---|---|---|---|
| 58 | / | 0 | 0 | 1 | 100 |
| 59 | BBP | 0.015 | 5 | 1 | 100 |
| 60 | BBP | 0.03 | 10 | 1 | 100 |
| 61 | BBP | 0.06 | 20 | 2 | 100 |
| 62 | BBP | 0.15 | 50 | 4 | 100 |
| 63 | BBP | 0.3 | 100 | 5 | 100 |
| 64 | BBP | 0.6 | 200 | 5 | 100 |
| 65 | DOZ | 0.015 | 5 | 2 | 100 |
| 66 | DOZ | 0.03 | 10 | 2 | 100 |
| 67 | DOZ | 0.06 | 20 | 3 | 100 |
| 68 | DOZ | 0.15 | 50 | 5 | 100 |
| 69 | DOZ | 0.3 | 100 | 5 | 100 |
| 70 | DOZ | 0.6 | 200 | 4 | 100 |

The results in this table indicate that it is preferable to add a plasticizer to the treatment solution of the present invention when a silicone softener is also used. The plasticizer can be added in various amounts, but preferably it is added at a minimum of 20% of the fluoroaliphatic radical-containing agent solids.

Examples 71 to 73 and Comparative Examples C-12 to C-14

In examples 71 to 73, FX-3530 was gradually replaced by the copolymers of (meth)acrylic acid esters with maleic anhydride as given in Table 1, so as to obtain a constant level of 0.3% solids on fabric after drying. Comparative Example C-12 was made without the addition of such a copolymer. In Comparative Examples C-13 and C-14 a homopolymer of the (meth)acrylic acid ester was used. All treatment solutions in MIBK of Examples 71 to 73 and Comparative Examples C-12 to C-14 were applied to Pes/Co Utex fabric. After treatment the fabric was dried at 70° C. for 30 min, eventually followed by heat treatment at 150° C. for 5 sec (ironed). The results of oil and water repellency tests are given in Table 12.

TABLE 12

Performance of Pes/Co Utex fabric treated with FX-3530 and (meth)acrylic acid ester/maleic anhydride copolymers of (meth)acrylic acid ester homopolymers

| Ex. | FX-3530 | Copolymer | Dried | | Dried + Ironed | |
|---|---|---|---|---|---|---|
| No. | Solids | Solids | OR | SR | OR | SR |
| C-12 | 0.3 | | 4 | 80 | 3 | 80 |
| C-13 | 0.24 | 0.06 | 4 | 80 | 4 | 80 |
| 71 | 0.24 | 0.06 | 4 | 100 | 4 | 100 |
| C-14 | 0.24 | 0.06 | 4 | 80 | 3 | 100 |
| 72 | 0.24 | 0.06 | 4 | 90 | 3 | 90 |
| 73 | 0.24 | 0.06 | 4 | 100 | 3 | 100 |

Examples 74 to 78 and Comparative Examples C-15 to C-17

In examples 74 to 78 blends were made of FX-3530 (0.3% SOF) with polymers comprising pendant cyclic carboxylic anhydrides (0.06% SOF) as given in table 13. Comparative example C-15 was made without the addition of a polymer comprising pendant cyclic anhydrides. In comparative examples C-16 and C-17, methacrylic acid ester copolymers of ODMA/AMA without grafted MA were used. The blends were applied to Pes/Co Utex fabric by solvent padding (MIBK), at 100% WPU. The fabrics were dried at 60° C. for 30 minutes. Alternatively, the fabrics were additionally ironed at 150° C. for 5 sec. The results of the performance of the treated fabrics are given in table 13.

TABLE 13

Performance properties of Pes/Co Utex substrate treated with fluoroaliphatic radical-containing agent (0.3% SOF) and polymer comprising pendant cyclic carboxylic anhydride groups (0.06% SOF)

| | | Pes/Co Utex | | | |
|---|---|---|---|---|---|
| Ex. | Polymer comprising pendant cyclic | Dried | | Dried + Ironed | |
| No. | carboxylic anhydride | OR | SR | OR | SR |
| 74 | (ODMA/AMA 90/10)/MA | 5 | 90 | 4 | 100 |
| 75 | (ODMA/AMA 80/20)/MA | 5 | 100 | 4 | 100 |
| 76 | Lithene LX-16-10MA | 3 | 100 | 3 | 100 |
| 77 | Lithene N4-5000-10MA | 3 | 100 | 3 | 100 |
| 78 | Lithene PM-25MA | 3 | 100 | 4 | 100 |
| C-15 | / | 4 | 70 | 3 | 70 |
| C-16 | ODMA/AMA 90/10 | 5 | 70 | 4 | 70 |
| C-17 | ODMA/AMA 80/20 | 4 | 70 | 4 | 70 |

The results in table 13 indicate that the addition of a polymer comprising pendant cyclic carboxylic anhydride groups to the fluoroaliphatic radical-containing agent gives an overall higher performance of the treated fabric.

What is claimed is:

1. A composition for imparting water and oil repellency to substrates selected from the group consisting of fibrous substrates and leather consisting of:

(a) a fluoroaliphatic radical-containing agent selected from the group consisting of fluoroaliphatic radical-containing polyesters, polyamides, polyepoxides, vinyl polymers, polyurethanes, N-methylol condensation products, and polycarbodiimides; and, a second ingredient, (b) a polymer comprising cyclic carboxylic anhydride groups selected from the group consisting of:

(i) copolymers of at least one cyclic carboxylic anhydride having an ethylenically unsaturated bond and at least one compound having a terminal ethylenically unsaturated bond selected from the group consisting of 1-octadecyl vinyl ether, octadecyl methylvinylether, 1 -hexadecene, 1-decene, 1-tetradecene, octadecene, octadecylmethacrylate, and butylmethacrylate; and (ii) polymers selected from the group consisting of polyolefins and poly(meth)acrylic acid derivatives having pendant cyclic carboxylic anhydride groups pendant from the main polymer chain;

with the proviso that the composition does not contain water if the fluoroaliphatic radical-containing agent is a water soluble or dispersible polyoxyalkylene compound and the polymer comprising cyclic carboxylic anhydride groups is a styrene-maleic anhydride copolymer or a vinyl acetate-maleic anhydride copolymer.

2. The composition of claim 1 wherein the polymer of part (b) is limited to polymers from part (b)(ii).

3. A substrate with water and oil repellent properties comprising a fibrous substrate having on the surface thereof an amount of a composition according to claim 1 effective to impart water and oil repellent properties thereto.

4. A substrate according to claim 3, wherein the substrate is selected from the group consisting of textile fabrics, fibers, non-wovens, leather, paper, and wood.

5. A water and oil repellency imparting composition comprising:

(a) a fluoroaliphatic radical-containing agent selected from the group consisting of fluoroaliphatic radical-containing polyesters, polyamides, polyepoxides, vinyl polymers, polyurethanes, N-methylol condensation products, and polycarbodiimides; and, a second ingredient, (b) a polymer comprising cyclic carboxylic anhydride groups selected from the group consisting of:

(i) copolymers of at least one compound having a terminal ethylenically unsaturated bond selected from the group consisting of aliphatic compounds having 2 to 30 carbon atoms, (meth)acrylic acid derivatives, vinyl ethers, and α-methylstyrene and at least one cyclic carboxylic anhydride having an ethylenically unsaturated bond; and (ii) polymers having pendant cyclic carboxylic anhydride groups; and (c) an additional component selected from the group consisting of silicone softeners and plasticizers selected from the group consisting of aliphatic or aromatic esters, polyesters, paraffins, substituted paraffins, and epoxy type plasticizers; with the proviso that the composition does not contain water if the fluoroaliphatic radical-containing agent is a water soluble or dispersible polyoxyalkylene compound and the polymer comprising cyclic carboxylic anhydride groups is a styrene-maleic anhydride copolymer or a vinyl acetate-maleic anhydride copolymer.

6. A solution comprising a solvent and an amount of the composition according to claim 5 effective to provide water and oil repellent properties to a substrate treated therewith.

7. The solution of claim 6 which is substantially free of water.

8. The composition according to claim 5, wherein the silicone softener is present in an amount of 5% to 300% by weight of component (a).

9. A method for imparting water and oil repellency to substrates selected from the group consisting of fibrous substrates and leather comprising applying to such substrates a composition consisting of:

(a) a fluoroaliphatic radical-containing polyurethane and, a second ingredient, (b) a polymer comprising cyclic carboxylic anhydride groups selected from the group consisting of:

(i) copolymers of at least one compound having a terminal ethylenically unsaturated bond selected from the group consisting of aliphatic compounds having 2 to 30 carbon atoms, (meth)acrylic acid derivatives, vinyl ethers, styrene and α-olefins containing an aromatic group and at least one cyclic carboxylic anhydride having an ethylenically unsaturated bond; and (ii) polymers having pendant cyclic carboxylic anhydride groups;

with the proviso that the composition does not contain water if the fluoroaliphatic radical-containing agent is a water soluble or dispersible polyoxyalkylene compound and the polymer comprising cyclic carboxylic anhydride groups is a styrene-maleic anhydride copolymer or a vinyl acetate-maleic anhydride copolymer.

* * * * *